US006456186B1

(12) United States Patent
Oglesbee

(10) Patent No.: US 6,456,186 B1
(45) Date of Patent: Sep. 24, 2002

(54) MULTI-TERMINAL FUSE DEVICE

(75) Inventor: John Wendell Oglesbee, Watkinsville, GA (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/562,265

(22) Filed: Apr. 29, 2000

Related U.S. Application Data

(60) Provisional application No. 60/161,802, filed on Oct. 27, 1999.

(51) Int. Cl.[7] ..... H01H 85/46; H01H 85/55; H01H 85/12

(52) U.S. Cl. ..... 337/161; 337/162; 337/159; 337/181; 337/283; 337/295; 337/297

(58) Field of Search ..... 337/161, 162, 337/159, 164, 180, 181, 283, 284, 285, 290, 293, 294, 297; 29/623; 361/104; 257/209, 529, 530; 438/467, 600, 601

(56) References Cited

U.S. PATENT DOCUMENTS

| | | | | | |
|---|---|---|---|---|---|
| 2,934,627 | A | * | 4/1960 | Bristol et al. | 200/135 |
| 3,585,556 | A | * | 6/1971 | Hingorany et al. | 337/297 |
| 4,296,398 | A | * | 10/1981 | McGalliard | 337/297 |
| 4,394,639 | A | * | 7/1983 | McGalliard | 337/292 |
| 4,625,162 | A | * | 11/1986 | Bosnyak | 324/51 |
| 4,626,818 | A | * | 12/1986 | Hilgers | 337/166 |
| 5,543,774 | A | * | 8/1996 | Lof | 337/297 |
| 5,552,338 | A | * | 9/1996 | Kang | 437/170 |
| 5,731,944 | A | * | 3/1998 | Yasukuni et al. | 361/104 |
| 5,886,611 | A | * | 3/1999 | Schaller et al. | 337/189 |
| 5,923,239 | A | | 7/1999 | Krueger | |
| 5,943,764 | A | | 8/1999 | Blecha | |
| 5,977,859 | A | * | 11/1999 | Kawamura et al. | 337/295 |
| 6,043,966 | A | | 3/2000 | Krueger | |
| 6,215,636 | B1 | * | 4/2001 | Hellemans | 361/104 |
| 6,225,867 | B1 | * | 5/2001 | Ilowski et al. | 330/298 |

FOREIGN PATENT DOCUMENTS

| | | | | |
|---|---|---|---|---|
| JP | 2000-133114 | * | 5/2000 | H01H/85/56 |

* cited by examiner

*Primary Examiner*—Anatoly Vortman
(74) *Attorney, Agent, or Firm*—Philip H. Burrus, IV

(57) ABSTRACT

A fusing device with an adjustable current rating. The fusing device has a common conductive trace, a plurality of individual conductive traces, and a plurality of fusible links. Each fusible link electrically connects the common conductive trace with a corresponding individual conductive trace, and each fusible link has a current rating. The current ratings of the plurality of fusible links are substantially identical to each other or different. Each fusible link can have one or more fusible elements. The fusible elements can be coupled in parallel or in series. Optionally, at least one fusible element can be trimmed through an intermediate terminal. Fusible links can be disposed in a same surface of a substrate or in different surfaces of the substrate.

18 Claims, 5 Drawing Sheets

MULTI-TERMINAL FUSE DEVICE

CROSS-REFERENCE TO RELATED APPLICATION

This application claims priority to U.S. Provisional Application Ser. No. 60/161,802, which was filed on Oct. 27, 1999.

BACKGROUND OF THE INVENTION

1. Field of the Invention

The present invention relates to a multi-terminal fuse device and, more specifically, to a multi-terminal fuse device for providing a range of current ratings.

2. Description of the Prior Art

Most, if not all, electrical and electronic circuits of all kinds need protection against electrical overloads. This protection for low voltage, distribution-type circuits, such those found in electrical appliance and/or electronic products for home or personal use, is typically provided by fuses. An electric fuse consists principally of a section of conductor, known as a fusible element or fusible link, of such properties and proportions that excessive current melts and thereby severs the circuit. A characteristic of an electric fuse is its current rating, which identifies the maximum current the electric fuse can allow to pass without melting or clearing. For example, a two (2) AMP fuse will melt or clear if current passing the fuse is greater than 2 AMP.

However, the prior art fuse with a given current rating may not provide proper protection against electrical overloads. For example, for a battery charger that has a fast charge mode and regular charge mode, fuses with different current ratings must be used in different modes because to charge battery in fast mode demands larger current than charge battery in regular mode. Moreover, a fusing device with large current rating is difficult and expensive to make.

There is therefore a need for a fusing device that has adjustable current rating and can be manufactured cost-efficiently.

DETAILED DESCRIPTION OF THE INVENTION

Figure 1:
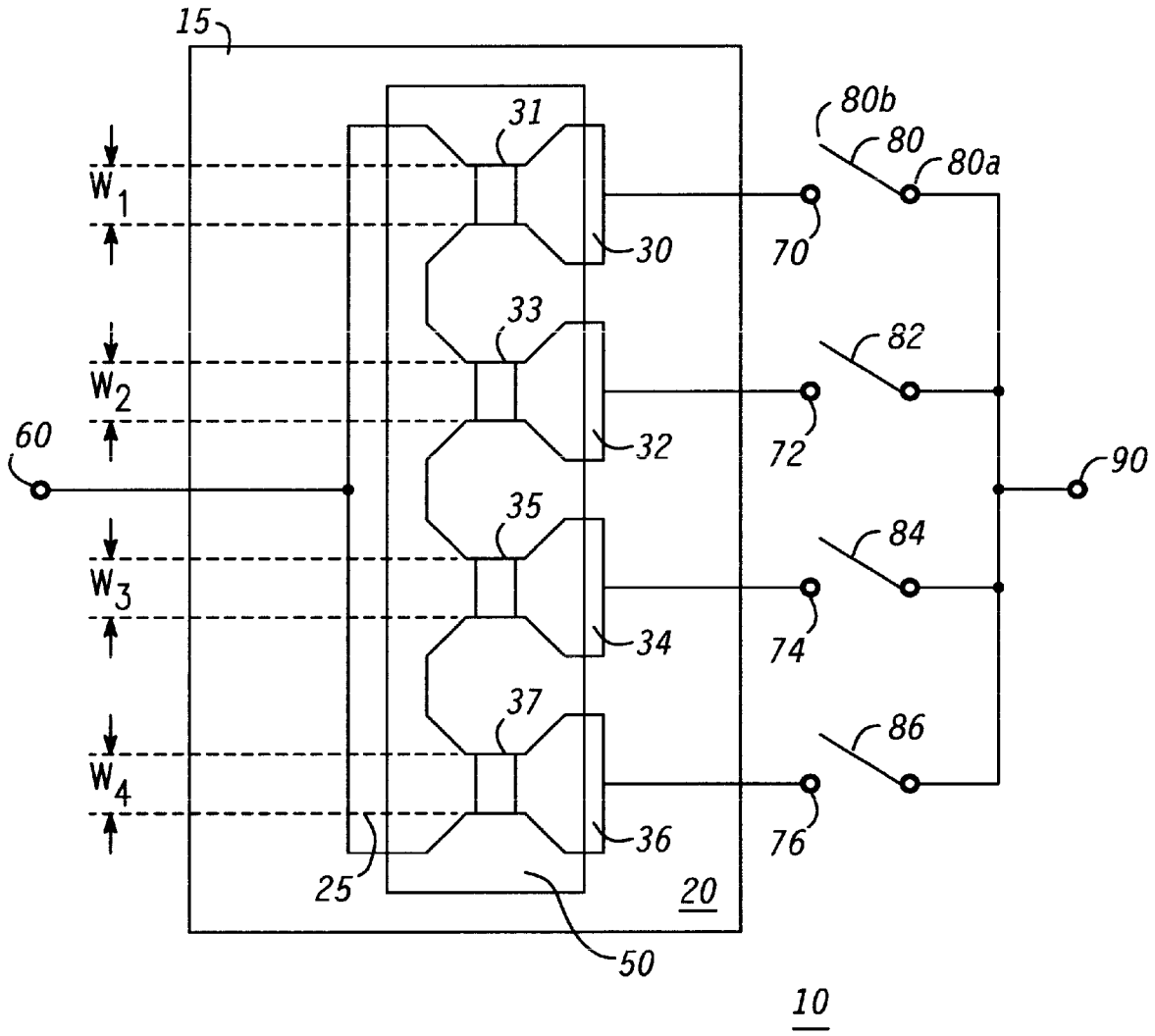
FIG. 1 is a schematic diagram of a fusing device in accordance with one embodiment of the invention.

Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on."

The present invention provides a fusing device that has an adjustable current rating and can offer a range of current ratings. With reference to FIG. 1, a fusing device 10 according to the present invention includes a common conductive trace 25 and a plurality of individual conductive traces 30,32, 34,36. The common conductive trace 25 and individual conductive traces 30, 32, 34, 36 are adapted to have additional electrical components connected thereto. For example, optionally, the common conductive trace 25 is electrically coupled to a first terminal 60, and each of the individual conductive traces 30, 32, 34, 36 is electrically coupled to a corresponding one of second terminals 70, 72, 74, 76. In particular, as shown in FIG. 1, the individual conductive trace 30 is electrically coupled to the corresponding second terminal 70, the individual conductive trace 32 is electrically coupled to the corresponding second terminal 72, the individual conductive trace 34 is electrically coupled to the corresponding second terminal 74, and the individual conductive trace 36 is electrically coupled to the corresponding second terminal 76. Note that although four individual conductive traces and second terminals are shown in this embodiment for the sake of simplicity, it will be readily understood by those of skill in the art that more or less individual conductive traces and/or second terminals could be employed in a typical commercial embodiment. Moreover, the number of individual conductive traces and the number of second terminals can be same, as shown in FIG. 1, or different (not shown).

Still referring to FIG. 1, the fusing device 10 further includes a plurality of fusible links 31, 33, 35, 37. Each fusible link electrically connects the common conductive trace 25 with a corresponding individual conductive trace. In particular, as shown in FIG. 1, fusible link 31 electrically connects the common conductive trace 25 with individual conductive trace 30, fusible link 33 electrically connects the common conductive trace 25 with individual conductive trace 32, fusible link 35 electrically connects the common conductive trace 25 with individual conductive trace 34, and fusible link 37 electrically connects the common conductive trace 25 with individual conductive trace 30. Again, although four fusible links are shown in this embodiment for the sake of simplicity, it will be readily understood by those skilled in the art that more or less fusible links could be employed in a typical commercial embodiment. Moreover, the number of individual conductive traces and the number of fusible links can be same, as shown in FIG. 1, or different (not shown).

Each fusible link has a current rating. As known to those skilled in the art, the current rating of a fusible link depends on intrinsic parameters such as width, thickness, and material composition of the fusible link as well as external parameters such as temperature. Because there are many factors that may affect the current rating of a fusible link, the current rating for a given fusible link has a tolerance range. Therefore, it will be readily understood by those skilled in the art that as used in the description herein and throughout the claims, a current rating with a specific number for a fusible link means that fusible link will melt or clear if current passing the fusible link is substantially in the range of the current rating. For example, if a fusible link has a current rating 2 AMP, the fusible link may melt or clear with respect to any current in the range of 2 AMP$\pm\delta$ AMP, where $\delta$ has a positive value, such as 0.2, and defines the tolerance range of the fusible link. For the embodiment shown in FIG. 1 where fusible links 31, 33, 35, and 37 are thin film type, each fusible link has a width. Other characteristics being equal, changing the width of a thin-film type fusible link changes its current rating. The fusing device 10 optionally has a substrate 15. The substrate 15 has a first surface 20 and a second surface 22. The substrate 15 can be electrically insulated, partially insulated, partially conductive or conductive. For the embodiment shown in FIG. 1, the substrate 15 is electrically insulated. The fusible links 31, 33, 35, and 37 are disposed on the first surface 20. An optional, protective coating 50 covers the fusible links 31, 33, 35, and 37 to protect the fusible links from impact and oxidation. Alternatively, the fusible links 31, 33, 35 and 37 can be located in a plastic housing for such protections.

Still referring to FIG. 1, the current ratings of the fusible links 31, 33, 35, and 37 can be substantially identical to each other or different. In one embodiment, the current rating of the fusible link 31 is chosen as $2^0$ (=1) AMP, the current rating of the fusible link 33 is chosen as $2^1$ (=2) AMP, the current rating of the fusible link 35 is chosen as $2^2$ (=4) AMP, and the current rating of the fusible link 37 is chosen as $2^3$ (=8) AMP. In this embodiment, the ratio of the current ratings of two neighboring fusible links substantially equals to 2 or 0.5. For example, the ratio of the current rating of fusible link 33 over fusible link 31 is 2 while the ratio of the current rating of fusible link 31 over fusible link 33 is 0.5. Likewise, the ratio of the current rating of fusible link 35 over fusible link 33 is 2 while the ratio of the current rating of fusible link 33 over fusible link 35 is 0.5.

The ratio of the current ratings of any two neighboring fusible links can be any non zero values in addition to the choice of 2 or 0.5 as discussed above. For example, the ratio of the current rating of fusible link 33 over fusible link 31 can be 0.1, 1, 1.5, 1.6, 3, 10 or other non-zero values. Furthermore, the current ratings of the fusible links 31, 33, 35, and 37 can be arranged from small to large, in an order as shown in the embodiment discussed above, or from large to small (not shown). They can also be arranged in a no particular order at all (not shown). In sum, each of the fusible links 31, 33, 35, and 37 can take any value for its current rating thereby to provide a wide range of ratio of the current ratings for two neighboring fusible links as well as various combinations of fusible links each having a same or different current rating. Therefore, the terminal 60 and each of the second terminals 70, 72, 74 and 76 provide a current rating determined by the corresponding fusible link, respectively. For example, the current rating between the terminal 60 and the second terminal 70 is determined by the corresponding fusible link 30. Because fusible links 31, 33, 35, and 37 can have same or different current ratings, the fusing device 10 is able to provide a range of current ratings to fit different uses. For example, for the embodiment as shown in FIG. 1 and discussed above, if a fusing device with current rating 1 AMP is needed in an application, terminal 60 and second terminal 70 can be properly connected into the circuit to meet the demand. If, on the other hand, a fusing device with current rating 4 AMP is needed in an application, terminal 60 and second terminal 74 can be properly connected into the circuit to meet the demand. Thus, the fusing device 10 can be termed as a "multi-terminal" fuse, wherein each terminal may give a different current rating. All of the second terminals 70, 72, 74 and 76 can be coupled in series to provide a maximum current rating 15 AMP.

Optionally, the fusing device 10 includes terminal pins 80, 82, 84 and 86. Each terminal pin has a first end and a second end. For example, terminal pin 80 has a first end 80*a* and a second end 80*b*. Each terminal pin is electrically coupled to an output terminal 90. Again, as shown in FIG. 1, the first end 80*a* of terminal pin 80 is electrically coupled to output terminal 90. The second end of a terminal pin can be selectively connected to a corresponding second terminal, thereby to provide a current rating between the first terminal 60 and the output terminal 90. For example, if the second end 80*b* of terminal 80 is chosen to be "on," i.e., the second end 80*b* of terminal 80 is connected to the corresponding second terminal 70, and all other second ends are left open, the current rating between the first terminal 60 and the output terminal 90 is determined by the current rating of the fusible link 31. For the embodiment discussed above where the current rating of the fusible link 31 is $2^0$ (=1) AMP, in this example the fusing device 10 can be effectively used as a fusing device with 1 AMP current rating. Alternatively, terminal pins 80, 82, 84 and 86 can be integrated into a connecting device (not shown) that selectively couples the fusing device with a proper current rating according to its applications.

As a second example, if the second ends of terminals 80 and 82 are chosen to be "on," and the second ends of terminal 84 and 86 are left open, the current rating between the first terminal 60 and the output terminal 90 is determined by the sum of the current rating of the fusible link 31 and the current rating of the fusible link 33. For the embodiment discussed above where the current rating of the fusible link 31 is $2^0$ (=1) AMP and the current rating of the fusible link 33 is chosen as $2^1$ (=2) AMP, in this example the fusing device 10 can be effectively used as a fusing device with 3 AMP current rating. Thus, for this particular embodiment of the present invention, by selectively connecting the terminal pin(s) to corresponding second terminal(s), the fusing device 10 can provide current rating with a value in a range of 1 to 15 AMPs for this embodiment. Of course, the range of current rating of the fusing device 10 can be broaden or narrowed by adding or subtracting fusible links, and/or having fusible links with new current ratings.

Figure 2:
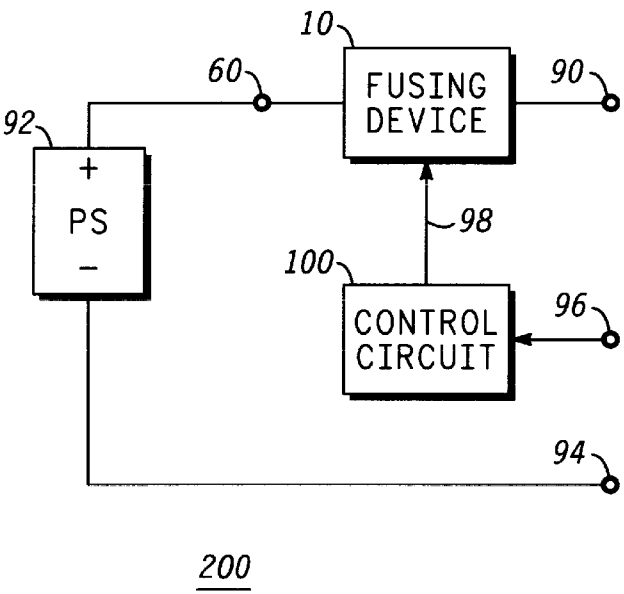
FIG. 2 is a block diagram of a fusing device that is in use in accordance with one embodiment of the invention.

The control and selection of current rating can be done manually or automatically. In FIG. 2, the fusing device 10 is shown in use related to a charging circuit 200. Fusing device 10 is connected to a power supply 92 through the first terminal 60. A control circuit 100 is electrically coupled to the fusing device 10. Control circuit 100 receives control signal(s) from control terminal or port 96 and output signal (s) 98 to the fusing device 10 to select proper fusing rate between the first terminal 60 and the output terminal 90. For instance, if a battery (not shown) to be charged is electrically coupled to terminals 90 and 94 for slow mode charging, control circuit 100 selects a fusing link or fusing links with proper current rating. If the battery is for fast charging, the logic circuit selects a different fusing link of different fusing links with a different, bigger current rating. Thus, the changing circuit 200 can be used to charge battery in different modes or charge different batteries without changing fusing devices. Moreover, the charging circuit 200 can be used to charge a cell phone, a laptop, or other electronic equipment. Note that although the fusing device 10 is shown in FIG. 2 in connection with a charging circuit 200, it will be readily understood by those skilled in the art that the fusing device can be employed in other applications.

Figure 3:
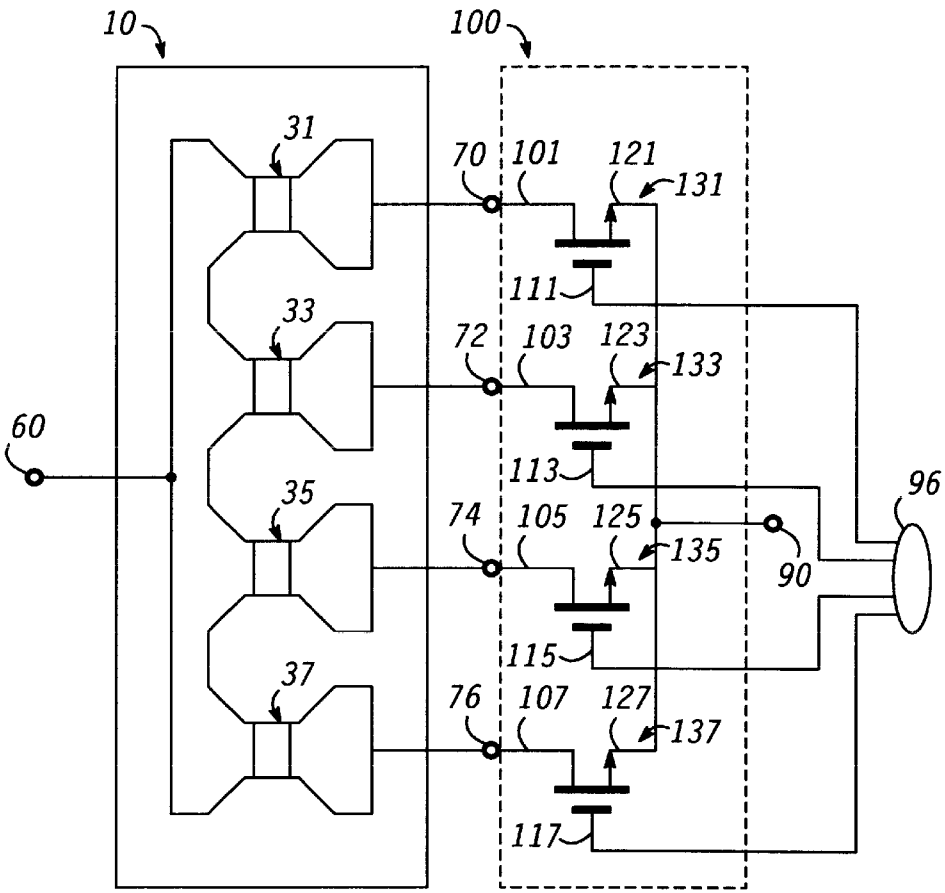
FIG. 3 is a schematic diagram of a fusing device in accordance with another embodiment of the invention.

Many control circuits including logic circuits known in the art can be utilized in the present invention for control circuit 100. FIG. 3 shows one embodiment where a plurality of transistors 131, 133, 135 and 137 have been used to function as both terminal pins and logic circuit. Each of transistors 131, 133, 135 and 137 has a source, a gate and a drain. For example, transistor 131 has a source 101, a gate 111, and a drain 121. The source of each of transistors 131, 133, 135 and 137 is electrically coupled to a corresponding second terminal. For example, the source 101 of the transistor 131 is electrically coupled to the corresponding second terminal 70, which in turn is electrically coupled to the fusible link 31. The gate of each of transistors 131, 133, 135 and 137 is electrically coupled to a control terminal or port 96 for receiving control signal(s). For example, the gate 111 of the transistor 131 is electrically coupled to the terminal or port 96. The drains 121, 123, 125, 127 of the transistors 131, 133, 135 and 137 are electrically coupled in common to provide an output through output terminal 90. Transistors 131, 133, 135 and 137 each receives control signal(s) from control terminal or port 96 to be selectively turned on to provide a proper current rating between the first terminal 60 and the output terminal 90. Again, while only four transistors are shown in this embodiment for the sake of simplicity, it will be readily understood by those skilled in the art that more or less transistors could be employed in a typical commercial embodiment.

As would be readily understood by those of skill in the art, each transistor described above is one of a variety of transistor types, such as a metal oxide semiconductor field effect transistor (MOSFET), or other type of field effect transistor, depending on the application and the type of substrate used. In certain applications, non-field effect transistors could be employed without departing from the scope of the invention. N-channel field effect transistors, p-channel transistors, bipolar junction transistors, etc., can be utilized to practice the present invention.

Alternatively, other types of control circuits and/or control elements can be used to control and/or select one or more fusible links with proper current ratings. In place of the control circuit 100 containing a number of transistors as shown in FIG. 3, control circuits and/or control elements as simple as a terminal pin, a switch, a gate pin on a power transistor or as complex as a microcontroller, or any combination of them as known to the people skilled in the art, can be utilized.

Figure 4:
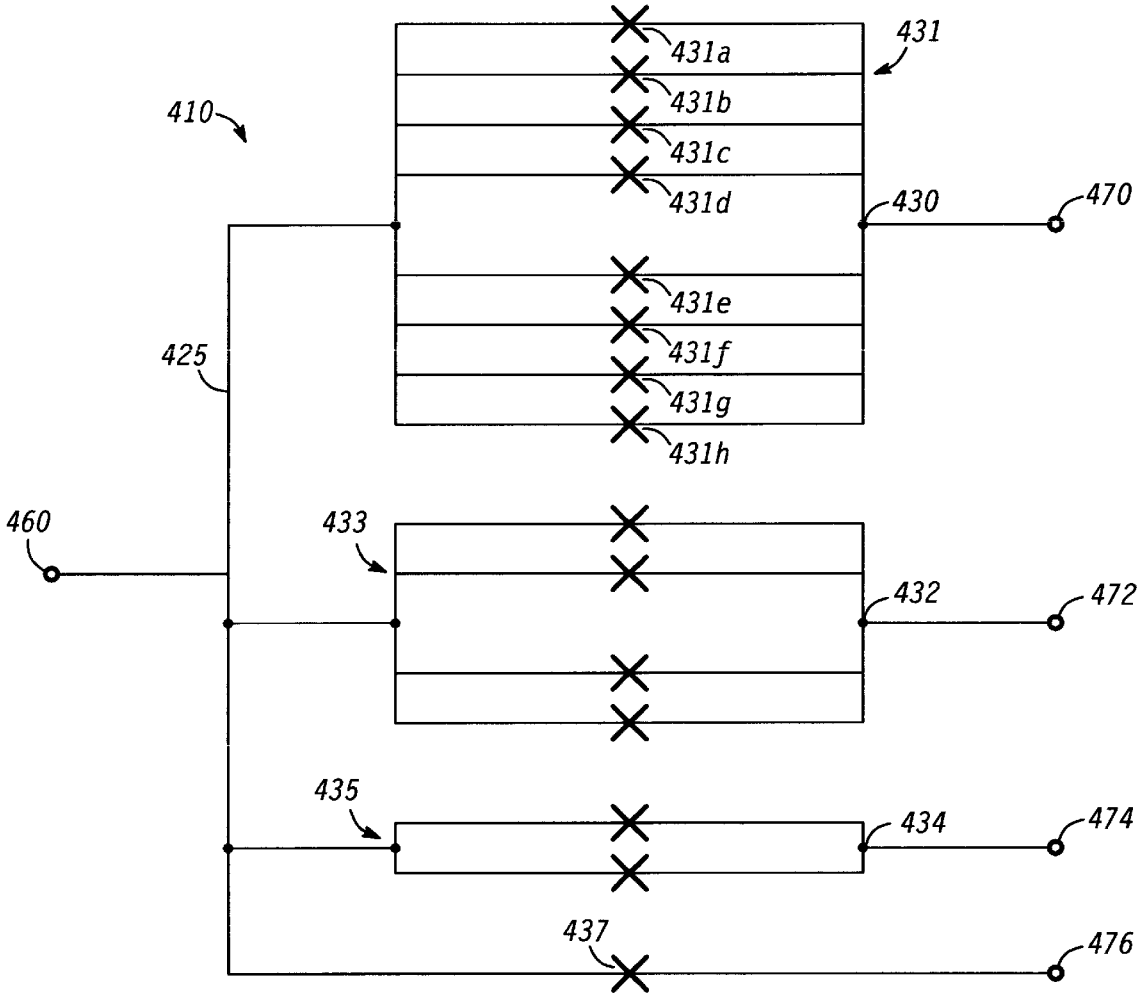
FIG. 4 is a schematic diagram of a fusing device in accordance with yet another embodiment of the invention.

Each fusible link can have one or more fusible elements. This feature of the invention is illustrated in FIG. 4. With reference to FIG. 4, a fusing device 410 according to one embodiment of the present invention includes a plurality of fusible links 431, 433, 435, 437. Each fusible link electrically connects the common conductive trace 425 with a corresponding individual conductive trace. Each fusible link has at least one fusible element. In particular, as shown in FIG. 4, fusible link 431 has fusible elements 431*a*–431*h*. The fusible elements 431*a*–431*h* are electrically connected to each other in parallel. All of the fusible elements 431*a*–431*h* are electrically coupled to first terminal 460 (through the common conductive trace 425) and to a second terminal 470 (through an individual conductive trace 430). Each of the fusible elements 431*a*–431*h* has a current rating. The current ratings of the fusible elements 431*a*–431*h* can be the same or different. For example, each of the fusible elements 431*a*–431*h* can have a current rating of 1 AMP in one embodiment, which effectively makes the fusible link 431 have a current rating of 8 AMP. One advantage for this embodiment is that fusible link 431 offers a range of current rating more than a prior art fuse available in the market can offer by utilizing several fusible elements with currently available current rating. Obviously, the current ratings of the fusible elements can have other values. For example, at least two of the fusible elements 431*a*–431*h* can have different current ratings. In one embodiment (not shown), fusible element 431*a* has a current rating 2 AMP, fusible elements 431*b*–431*h* all have a current rating 1 AMP. In another embodiment (not shown), each of the fusible elements 431*a*–431*h* has a different current rating from 0.0001 AMP to 8 AMP.

Still referring to FIG. 4, fusible links 431, 433, 435 and 437 each can have N fusible elements, where N is a integer no smaller than 1. Moreover, each of fusible links 431, 433, 435 and 437 can have same or different N value. Furthermore, the current ratings of the N fusible elements for each fusible link can be substantially the same or different. For the embodiment shown in FIG. 4, fusible link 431 has eight (8) fusible elements 431*a*–431*h*, fusible link 433 has four (4) fusible elements 433*a*–433*d*, fusible link 435 has two (2) fusible elements 435*a*–435*b*, and fusible link 437 has just one fusible element 437 that is itself. For this embodiment, if current ratings of all fusible elements are chosen as 1 AMP, the fusing device 410 can have an effective, adjustable current rating in the range of from 1 AMP to 15 AMP. For example, if one wants a fusing device with a current rating of 5 AMP, one can select and turn on the fusible link 433 and fusible link 431 in parallel, and turn off the fusible links 431 and 435. In this way, the fusing device 410 has an effective current rating of 5 AMP. If the current ratings of the fusible elements for each fusible link are chosen differently, the fusing device 410 will have a different current rating range. Again, although four fusible links are shown in this embodiment for the sake of simplicity, it will be readily understood by those skilled in the art that more or less fusible links could be employed in a typical commercial embodiment.

Figure 5:
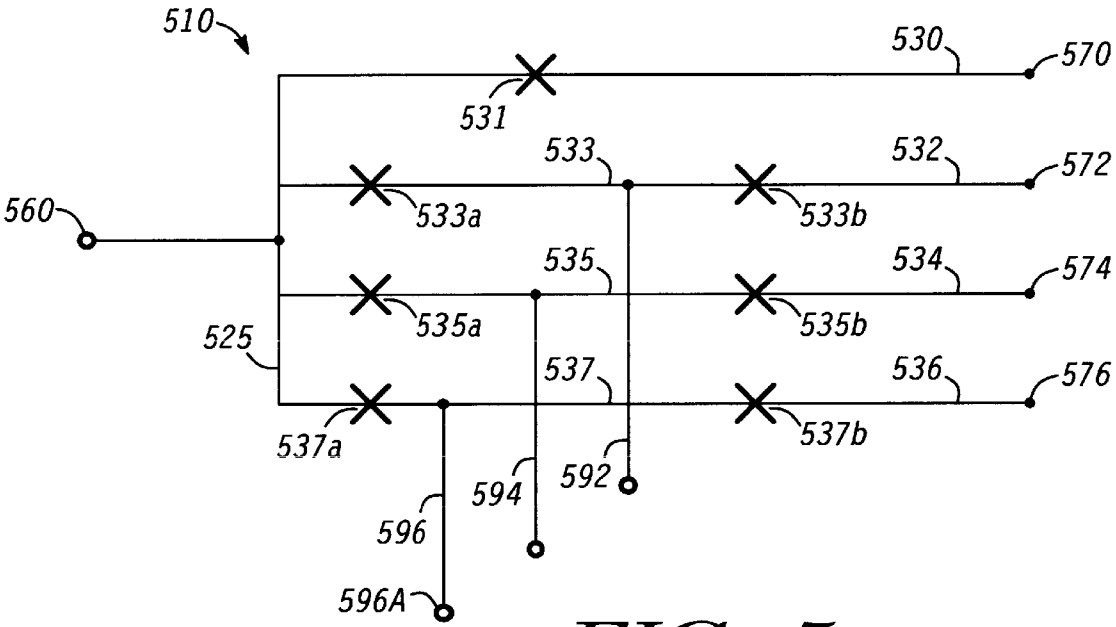
FIG. 5 is a schematic diagram of a fusing device in accordance with another embodiment of the invention.

FIG. 5 shows a fusing device 510 according to another embodiment of the present invention. The fusing device 510 includes a plurality of fusible links 531, 533, 535, 537. Each fusible link electrically connects the common conductive trace 525 with a corresponding individual conductive trace. For example, the fusible link 531 electrically connects the common conductive trace 525 with a corresponding individual conductive trace 530, which is electrically coupled to a corresponding second terminal 570. The fusing device 510 has at least one fusible link which comprises at least two fusible elements electrically coupled in series.

In the embodiment shown in FIG. 5, for example, fusible link 537 has a first fusible element 537*a* and a second fusible element 537*b* connected in series through an intermediate terminal 596. The first fusible element 537*a* is electrically coupled to the common conductive trace 525. The second fusible element 537*b* is electrically coupled to a corresponding individual conductive trace 536, which is electrically coupled to a corresponding second terminal 576. The intermediate terminal 596 has a connection point 596*a* that is adapted for receiving a testing current to trim at least one of the first fusible element 537*a* and the second fusible element 537*b*. For example, if in one embodiment the first fusible element 537*a* has a current rating of 0.1 AMP and the second fusible element 537*b* has a current rating of 0.2 AMP, connecting a current source (not shown) with a given current 0.15 AMP between the first terminal 560 and the connection point 596*a* will melt the first fusible element 537*a*. Similar to fusible link 537, fusible link 535 has a first fusible element 535*a* and a second fusible element 535*b* connected in series through an intermediate terminal 594, and fusible link 533 has a first fusible element 533*a* and a second fusible element 533*b* connected in series through an intermediate terminal 592.

Each of the first and second fusible elements for a fusible link has a current rating. The current ratings of the first and second fusible elements of the same fusible link can be same or different. Likewise, the current ratings of the first and second fusible elements of different fusible links can be the same or different. For example, in one embodiment as shown in FIG. 5, the fusible link 531 has a current rating of 0.94 M AMP, where M is a non zero value, the first and second fusible elements of fusible link 533 each has a current rating of 0.04 M AMP, the first and second fusible elements of fusible link 535 each has a current rating of 0.02 M AMP, and the first and second fusible elements of fusible link 537 each has a current rating of 0.01 M AMP. The fusing device 510 thus can have an effective, adjustable current rating in the range of from 0.94 AMP to 1.08 M AMP. For example, if one wants a fusing device with a current rating of 1 M AMP, one can select and turn on the fusible links 531, 535 and 537 in parallel, and turn off the fusible link 533. Note that fusible links 531, 533, 535 and 537 can be electrically coupled together by connecting second terminals 570, 572, 574 and 576 in series, which results in a fusing device that has a maximum current rating 1.08 M AMP but trimmable in the range of from 0.94 M AMP to 1.08 M AMP. Again, although four fusible links are shown in this embodiment for the sake of simplicity, it will be readily understood by those skilled in the art that more or less fusible links could be employed in a typical commercial embodiment. Moreover, a fusible link can have more than two fusible elements connected in series by more than one intermediate terminal.

Figure 7:
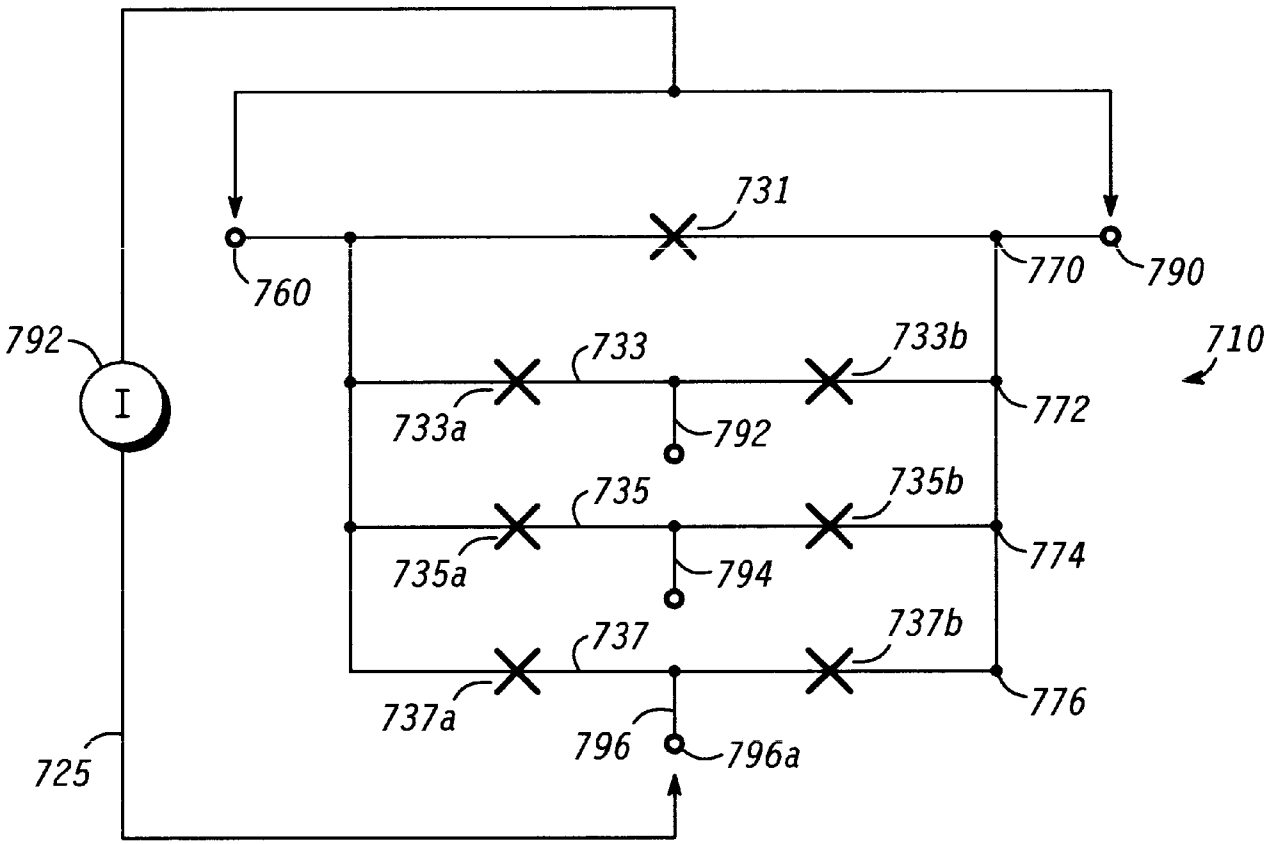
FIG. 7 is a schematic diagram of a fusing device in accordance with another embodiment of the invention as shown in FIG. 5.

One advantage for the embodiment shown in FIG. 5 is that the fusing device 510 has fusible elements that are trimmable. The fusing device 510 is useful in situations where a fusing device with accurate current rating is needed, one or more fusible elements of the fusing device 510 can be trimmed through one or more connection points without interrupting the application in use. In one embodiment as shown in FIG. 7, a test current source 792 provides current to a fusing device 710 through a first terminal 760, an output terminal 790 and a connection point 796*a* to trim fusible elements 737*a* and 737*b* of fusible link 737 so that the fusing device 710 has an effective currenting rating substantially in the sum of current ratings of fusible links 731, 733 and 735. Alternatively, testing current can be applied to fusible link 735 through intermediate terminal 794, and/or fusible link 733 through intermediate terminal 792 to trim corresponding fusible elements.

Figure 6:
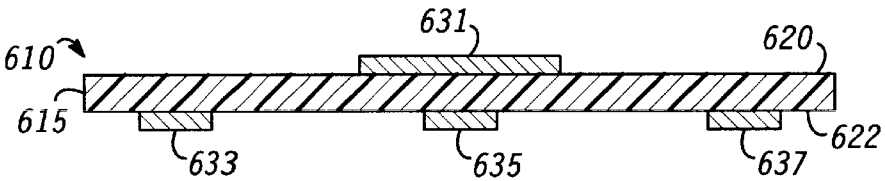
FIG. 6 is a schematic side view of the fusing device in accordance with the embodiment of the invention as shown in FIG. 5.

Fusible links of the thin-film type fusing device according to the present invention can be disposed in a same surface of a substrate. Alternatively, fusible links can be dispose in different surfaces of the substrate. The substrate can be electrically isolated, partially isolated, conductive or partially conductive. FIG. 6 shows a fusing device 610 that has fusible links disposed in both surfaces of a substrate 615. In particular, fusible link 631 is disposed at a first surface 620 of the substrate 615, and fusible links 633, 635 and 637 are disposed at a second surface 622 of the substrate 615. Each of the fusible links 631, 633, 635 and 637 has a width, a thickness and a current rating. Other characteristics being equal, changing the width of a fusible link changes its current rating. Likewise, changing the thickness of a fusible link changes its current rating as well. The fusing device 610 can be manufactured through a twin plating process known in the art. In a twin plating process, one surface of the substrate is completely masked, while the other is left completely exposed. The "half-masked substrate" is then subjected to the plating process until a thickness A of a conductive material has been deposited upon the unmasked half. Once this has been accomplished, the mask on the other surface is removed. The substrate is again subjected to the plating process for a shorter time, allowing a thickness B of the conductive material to be deposited upon both surfaces of the substrate. Hence, the first surface has a film of the conductive material with a thickness A+B, while the other surface has only a film of the conductive material with a thickness B. By way of example, if A is 100 Angstroms, and B is 10 Angstroms, the first surface would end up with 110 Angstroms while the other has 10. Hence, the current rating of a fusible link finally formed on the first surface would be on the order of 11 times greater than the current rating of a fusible link formed on the second surface of the substrate according to this process.

The fusing device in accordance with the present invention can be integrated as a thin film fuse directly into the circuitry of a PC board. Alternatively, it can be packed in a traditional, single package form that can be used in a variety of applications.

In sum, in one aspect, the present invention provides a fusing device having a common conductive trace, a plurality of individual conductive traces, and a plurality of fusible links. Each fusible link electrically connects the common conductive trace with a corresponding individual conductive trace, and each fusible link has a current rating. The current ratings of the plurality of fusible links are substantially identical to each other or different.

In another aspect, the present invention provides a fusing device having a common conductive trace, a plurality of individual conductive traces, and a plurality of fusible links. Each fusible link electrically connects the common conductive trace with a corresponding individual conductive trace, and each fusible link has a current rating. A first terminal is electrically coupled to the common conductive trace. A plurality of second terminals each is electrically coupled to a corresponding individual conductive trace. The fusing device further has a plurality of transistors. Each transistor has a source, a gate and a drain. The gate of each of the plurality of transistors is electrically coupled to a corresponding gate of a different one of the transistors. The source of each of the plurality of transistors is electrically coupled to a corresponding second terminal. And the drains of the plurality of transistors are electrically coupled in common to provide an output through an output terminal. The current ratings of the plurality of fusible links are substantially identical to each other or different. The range of current rating of the fusing device is adjustable by selectively turning on at least one transistor.

In yet another aspect, the present invention relates to a fusing device having a substrate having a first surface and a second surface. At least one fusible link is disposed on the first surface of the substrate and at least one fusible link is disposed on the second surface of the substrate. The fusing device further has a common conductive trace and a plurality of individual conductive traces, wherein each fusible link has a current rating and electrically connects the common conductive trace with a corresponding individual conductive trace.

The above-described embodiments are given as illustrative examples only. It will be readily appreciated that many deviations may be made from the specific embodiments disclosed in this specification without departing from the invention. Accordingly, the scope of the invention is to be determined by the claims below rather than being limited to the specifically described embodiments above.

What is claimed is:

1. In combination, a fusing device comprising:

a. a common conductive trace;

b. a plurality of individual conductive traces; and c. a plurality of fusible llinks, each fusible link electrically connecting the common conductive trace with a corresponding individual conductive trace, and each fusible link having a current rating; and a connecting device, wherein the connecting device comprises:

a. an output terminal; and b. a plurality of terminal pins, each terminal pin having a first end and a second end, wherein the first end of each terminal pin is electrically coupled to the output terminal, and the second end of at least one terminal pin is selectively connected to a corresponding second terminal, thereby to provide a current rating between the first terminal and the output terminal.

2. The fusing device of claim 1, wherein the connecting device further comprises a control circuit to selectively connect the second end of at least one terminal pin to a corresponding second terminal.

3. A fusing device comprising:

a. a common conductive trace;

b. a plurality of individual conductive traces; and c. a plurality of fusible llinks, each fusible link electrically connecting the common conductive trace with a corresponding individual conductive trace, and each fusible link having a current rating;

wherein at least one fusible link comprises a first fuse element, a second fuse element and an intermediate terminal connecting the first fuse element and the second fuse element in series, the first fuse element being electrically coupled to the common conductive trace and the second fuse element being electrically coupled to the individual conductive trace connected to the at least one fusible link.

4. The fusing device of claim 3, wherein the first fuse element has a current rating and the second fuse element has a current rating.

5. The fusing device of claim 4, wherein the current ratings of the first fuse element and the second fuse element are substantially identical to each other.

6. The fusing device of claim 4, wherein the current ratings of the first fuse element and the second fuse element are different.

7. The fusing device of claim 3, wherein the intermediate terminal has a connection point to receive a testing current to trim at least one of the first and second fuse elements.

8. A fusing device comprising:

a. a common conductive trace;

b. a plurality of individual conductive traces;

c. a plurality of fusible links, each fusible link electrically connecting the common conductive trace with a corresponding individual conductive trace, and each fusible link having a current rating;

d. a first terminal electrically coupled to the common conductive trace;

e. a plurality of second terminals each electrically coupled to a corresponding individual conductive trace; and f. a plurality of control elements, each being electrically coupled to a corresponding second terminal, electrically coupled in common to provide an output;

wherein at least two of the plurality of fusible links have different current ratings.

9. The fusing device of claim 8, wherein each fusible link has a width, and at least two of the plurality of fusible links have different widths.

10. The fusing device of claim 9, wherein the ratio of the current ratings of two neighboring fusible links is a non zero value.

11. The fusing device of claim 10, wherein the ratio of the current ratings of two neighboring fusible links substantially equals to 2 or 0.5.

12. A fusing device comprising:

a. a common conductive trace;

b. a plurality of individual conductive traces;

c. a plurality of fusible links, each fusible link electrically connecting the common conductive trace with a corresponding individual conductive trace, and each fusible link having a current rating;

d. a first terminal electrically coupled to the common conductive trace;

e. a plurality of second terminals each electrically coupled to a corresponding individual conductive trace; and f. a plurality of control elements, each being electrically coupled to a corresponding second terminal, electrically coupled in common to provide an output;

wherein each control element comprises a transistor having a source, a gate and a train, the gate of each of the plurality of transistors being electrically coupled to a control port for receiving control signals, the source of each of the plurality of transistors being electrically coupled to a corresponding second terminal, and the drains of the plurality of transistors being electrically coupled in common to provide the output.

13. The fusing device of claim 12, wherein the current rating between the first terminal and the output is adjusted by turning on at least one selected transistor or more selected transistors from the control port.

14. A fusing device comprising:

a. a substrate having a first surface and a second surface;

b. at least one fusible link disposed on the first surface of the substrate;

c. at least one fusible link disposed on the second surface of the substrate;

d. a common conductive trace; and e. a plurality of individual conductive traces;

wherein each fusible link has a current rating and electrically connects the common conductive trace with a corresponding individual conductive traces; further wherein at least one fusible link comprises a first fuse element, a second fuse element and an intermediate terminal connecting the first fuse element and the second fuse element in series, the first fuse element being electrically coupled to the common conductive trace and the second fuse element being electrically coupled to the individual conductive trace connected to the at least one fusible link.

15. The fusing device of claim 14, wherein the first fuse element has a current rating and the second fuse element has a current rating.

16. The fusing device of claim 15, wherein the current ratings of the first fuse element and the second fuse element are different.

17. The fusing device of claim 15, wherein the current ratings of the first fuse element and the second fuse element are substantially identical to each other.

18. The fusing device of claim 14, wherein the intermediate terminal has a connection point to receive a testing current to trim at least one of the first and second fuse elements.

* * * * *

UNITED STATES PATENT AND TRADEMARK OFFICE

CERTIFICATE OF CORRECTION

PATENT NO. : 6,456,186 B1
DATED : February 2, 2004
INVENTOR(S) : Oglesbee, John W.

It is certified that error appears in the above-identified patent and that said Letters Patent is hereby corrected as shown below:

Column 9,
Line 2, “llinks” should be -- links --.
Line 23, “llinks” should be -- links --.

Signed and Sealed this

Third Day of August, 2004

JON W. DUDAS
*Acting Director of the United States Patent and Trademark Office*